US006609742B1

(12) United States Patent
Macom et al.

(10) Patent No.: US 6,609,742 B1
(45) Date of Patent: Aug. 26, 2003

(54) LIFTING APPARATUS FOR MANIPULATING MANHOLE CASTINGS AND THE LIKE

(76) Inventors: William C. Macom, 5301 N. Oak, Davison, MI (US) 48423; Joseph H. Landry, 11341 E. Carpenter, Davison, MI (US) 48423; William R. Gregor, 11478 E. Carpenter, Davison, MI (US) 48423; James Rasmussen, 8345 Teachout Rd., Otisville, MI (US) 48463

( * ) Notice: Subject to any disclaimer, the term of this patent is extended or adjusted under 35 U.S.C. 154(b) by 0 days.

(21) Appl. No.: 09/848,488

(22) Filed: May 3, 2001

(51) Int. Cl.[7] ..... B66C 1/28

(52) U.S. Cl. ..... 294/82.13; 294/90; 294/92; 294/104

(58) Field of Search ..... 294/90–92, 104, 294/82.1, 82.11, 82.13, 110.1, 63.1, 901, 67.31, 81.51, 81.56, 81.61, 16, 17

(56) References Cited

U.S. PATENT DOCUMENTS

| | | | | | |
|---|---|---|---|---|---|
| 626,350 | A | | 6/1899 | Tiffany | |
| 1,021,564 | A | | 3/1912 | Warnitz | |
| 1,109,190 | A | * | 9/1914 | Werner | 294/28 |
| 1,326,802 | A | * | 12/1919 | Strathern | 248/72 |
| 2,079,240 | A | * | 5/1937 | Bruns | 294/82.13 |
| 2,573,216 | A | * | 10/1951 | Natoli | 294/74 |
| 2,618,504 | A | * | 11/1952 | Penn | 294/101 |
| 2,680,644 | A | * | 6/1954 | Marconi | 294/67.2 |
| 2,708,592 | A | * | 5/1955 | Dalkranian | 294/31.1 |
| 3,330,591 | A | * | 7/1967 | Pavelka | 294/104 |
| 3,333,883 | A | * | 8/1967 | Kikuchi | 294/104 |
| 3,488,079 | A | * | 1/1970 | Stinchfield | 294/82.13 |
| 4,213,647 | A | * | 7/1980 | Thurmond, Jr. | 294/104 |
| 4,482,182 | A | * | 11/1984 | Mortensen | 294/15 |
| 5,004,282 | A | * | 4/1991 | Perry | 294/16 |
| 5,165,661 | A | | 11/1992 | Wright | |
| 5,306,062 | A | | 4/1994 | Dodge | |
| 5,382,131 | A | | 1/1995 | Werthmann | |
| 5,476,300 | A | | 12/1995 | Dodge | |

* cited by examiner

*Primary Examiner*—Dean J. Kramer
(74) *Attorney, Agent, or Firm*—Young & Basile, P.C.

(57) ABSTRACT

A lifting apparatus for manipulating manhole castings and the like having at least one pinch clamp with an inner leg and an outer leg opposing one another wherein the inner leg and the outer leg are engageable with the manhole casting. A foot of the pinch clamp is connected to at least one of the inner leg and the outer leg wherein the foot is wider than the width of the inner leg and the outer leg and is engageable with the manhole casting. A flexible support is pivotally connected to the pinch clamp and is connectable to a lifting device wherein the foot and the legs of the pinch clamp are engageable with the manhole casting when the flexible support is pulled taut. Preferably, the inner and outer legs are separate structures pivotally connected thereto. Alternatively, the inner and outer leg may be integrally fabricated from a one-piece structure. The flexible supports are connected to a connector which is connectable to a lifting device.

19 Claims, 3 Drawing Sheets

LIFTING APPARATUS FOR MANIPULATING MANHOLE CASTINGS AND THE LIKE

FIELD OF THE INVENTION

The invention relates to a lifting apparatus, and more particularly, a lifting apparatus for engaging, lifting, moving, and lowering manhole castings and the like.

BACKGROUND OF THE INVENTION

During the excavation and reconstruction of roads, buildings, and parking lots, it is necessary to remove, manipulate, and replace manhole covers and similar grates. These various manhole covers and grates may weigh anywhere between 300 to 600 pounds. Traditionally, several laborers would attempt to lift and move these manhole covers and grates in proper position. However, the extreme weight and bulkiness of these manhole covers and grates places such laborers at risk of injury since there is no good way to lift such heavy and bulky objects either manually or by machine.

Manhole covers and grates, as well as other related items, come in a variety of shapes and sizes. It is desirable to be able to lift these elements with one simple device that is adaptable to a wide range of construction equipment found at a construction site. Previous devices have provided adjustable mechanisms using multiple pieces and pins to lock the pieces into position. These devices lack the durability and practicality required for a construction site. The pins and extended members typically break or are lost when used and stored about a construction site.

It would be desirable to provide a lifting apparatus that was simple and durable while also providing for a certain degree of adjustment. In addition, it would also be desirable to provide a lifting apparatus that could be utilized in conjunction with a lifting device so that laborers would not be required to manually lift heavy objects and the like.

SUMMARY OF THE INVENTION

The present invention relates to a lifting apparatus for manipulating manhole castings and the like. The lifting apparatus preferably provides at least one pinch clamp having an inner leg and an outer leg opposing one another wherein the inner leg and the outer leg are engageable with a manhole casting. A foot on the pinch clamp is connected to at least one of the inner legs and the outer legs wherein the foot is wider than the width of the inner leg and the outer leg and is engageable with the manhole casting. A flexible support is pivotally connected to the pinch clamp and connectable to a lifting device wherein the foot and the inner and outer legs of the pinch clamp are engageable with the manhole casting when the flexible support is pulled taut by the lifting device. A connector is pivotally connected to the flexible support and connectable to the lifting device.

In the preferred embodiment, the inner leg and the outer leg of the pinch clamp are independent, substantially parallel structures pivotally connected about a pivotal axis. The inner and outer legs pivot in a plane substantially normal to the pivotal axis. In an alternative embodiment, the inner and outer legs are integrally fabricated to form a substantially C-shaped, one-piece structure.

In yet another embodiment, a multipurpose hook is pivotally connected to the end of the second flexible support member the second flexible support is pivotally connected to the connector.

BRIEF DESCRIPTION OF THE DRAWINGS

The description herein makes reference to the accompanying drawings wherein like reference numerals refer to like parts throughout several views and wherein.

DESCRIPTION OF THE PREFERRED EMBODIMENT

Figure 1:
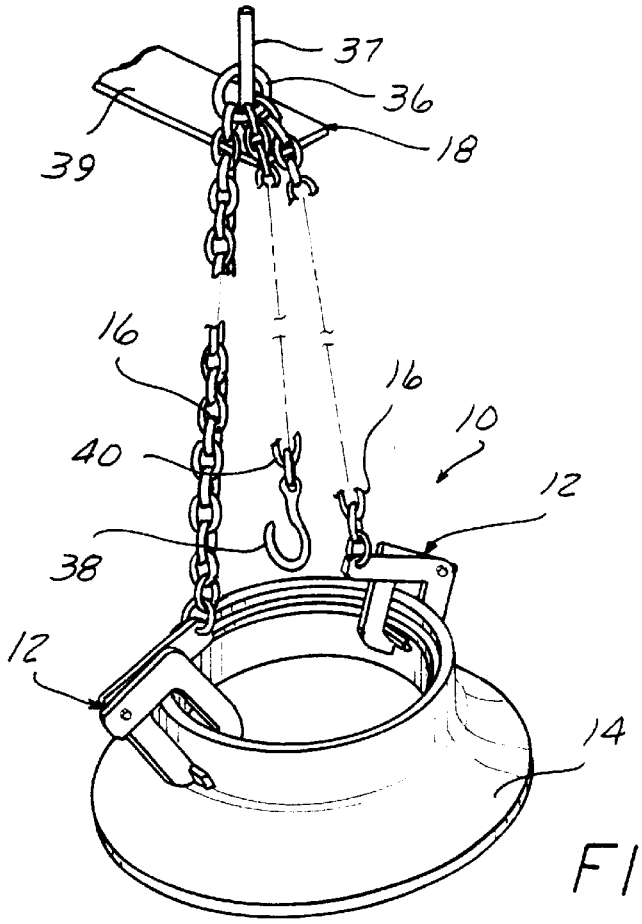
FIG. 1 is a perspective view showing the lifting apparatus of the present invention being utilized to lift a manhole casting.

Referring to the drawings, the present invention will now be described in detail with reference to the preferred embodiment.

FIGS. 1–4B show a lifting apparatus 10 of the present invention in its preferred form. The lifting apparatus 10 provides at least one pinch clamp 12 engageable with a manhole casting 14. Preferably, the lifting apparatus 10 utilizes a pair of pinch clamps 12, although more than two pinch clamps 12 may be utilized to lift large manhole castings 14. Flexible supports 16 are pivotally connected to the pinch clamps 12 and connectable to a lifting device 18, such as a hydraulically powered or motorized forklift.

In order to engage the manhole casting 14, the pair of pinch clamps 12 are positioned on opposite sides of the manhole casting 14. If several pinch clamps 12 are utilized, then the pinch clamps 12 are equally spaced about the manhole casting 14. Each of the pinch clamps 12 provides an inner leg 20 and an outer leg 22. The inner and outer legs 20, 22 each have a substantially flat, plate-like structure having a substantially L-shaped construction. Each of the legs 20, 22 are fabricated from a hardened steel, although the legs 20, 22 may be fabricated from any high strength material commonly known to those skilled in the art. The inner leg 20 and the outer leg 22 are pivotally connected to one another by a fastener or pivot pin 24. The fastener 24 extends through corresponding apertures 27 provided in the legs 20, 22 such that the inner and outer legs 20, 22 pivot about a pivotal axis 25 defined by the longitudinal axis of the fastener 24. The inner and outer legs 20, 22 are substantially parallel and pivot in substantially parallel planes substantially normal to the longitudinal axis of the fastener 24.

Figure 2:
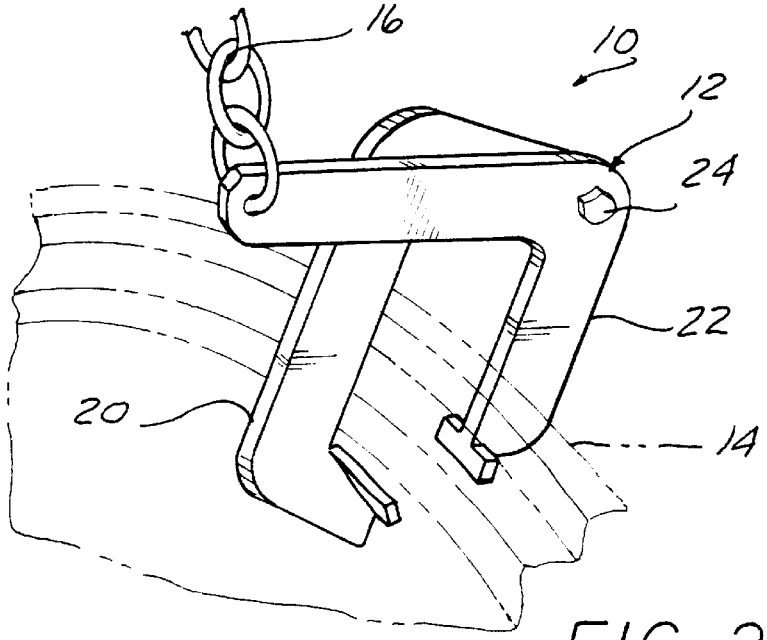
FIG. 2 is a perspective view of one of the pinch clamps of the present invention engaging a manhole casting.
Figure 4A:
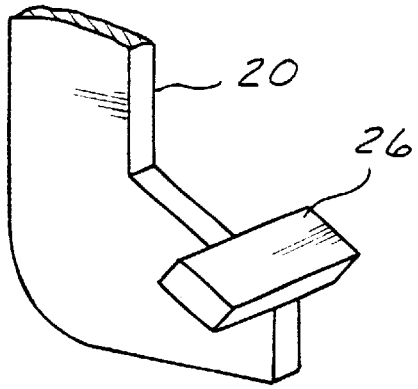
FIG. 4A is a cutaway perspective view showing the foot on the inner leg of the pinch clamp of the present invention.
Figure 4B:
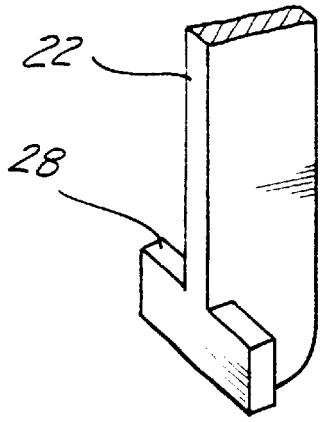
FIG. 4B is a perspective cutaway view of the foot of the outer leg of the pinch clamp of the present invention.
Figure 5:
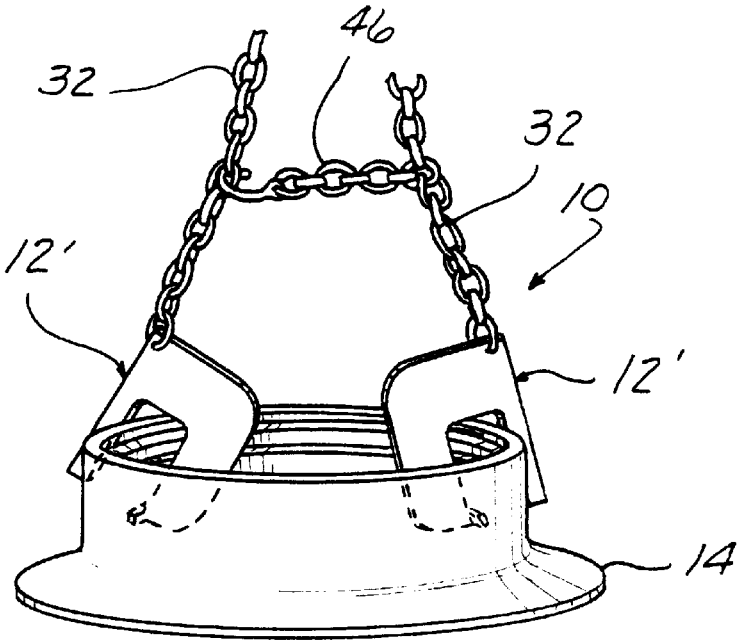
FIG. 5 is a perspective view of an alternative embodiment of the present invention being utilized to lift a manhole casting.
Figure 6:
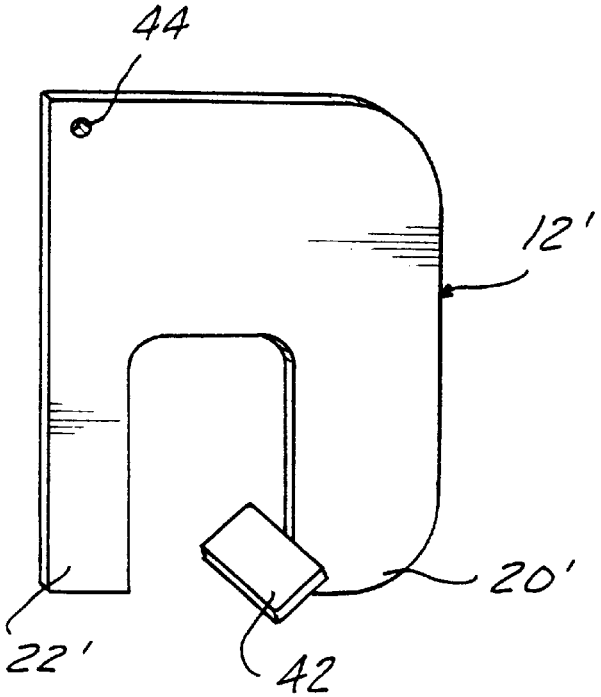
FIG. 6 is a perspective view of one of the pinch clamps of the alternative embodiment of the present invention.

It will be noted that engagement with the manhole casting 14 is made by feet 26, 28 which are welded to the inner and outer legs 20, 22, respectively. Each of the feet 26, 28 provide a contact surface that is wider than the width of their respective legs 20, 22, as seen in FIGS. 2, 4A, and 4B. The foot 26 on the inner leg 20 is mounted atop the inner surface of the inner leg 20, and the foot 28 on the outer leg 22 is mounted flush with the inner surface of the outer leg 22. The position of the feet 26, 28 relative to the inner and outer legs 20, 22 are designed to provide an optimum contact surface with the manhole casting 14.

Figure 3:
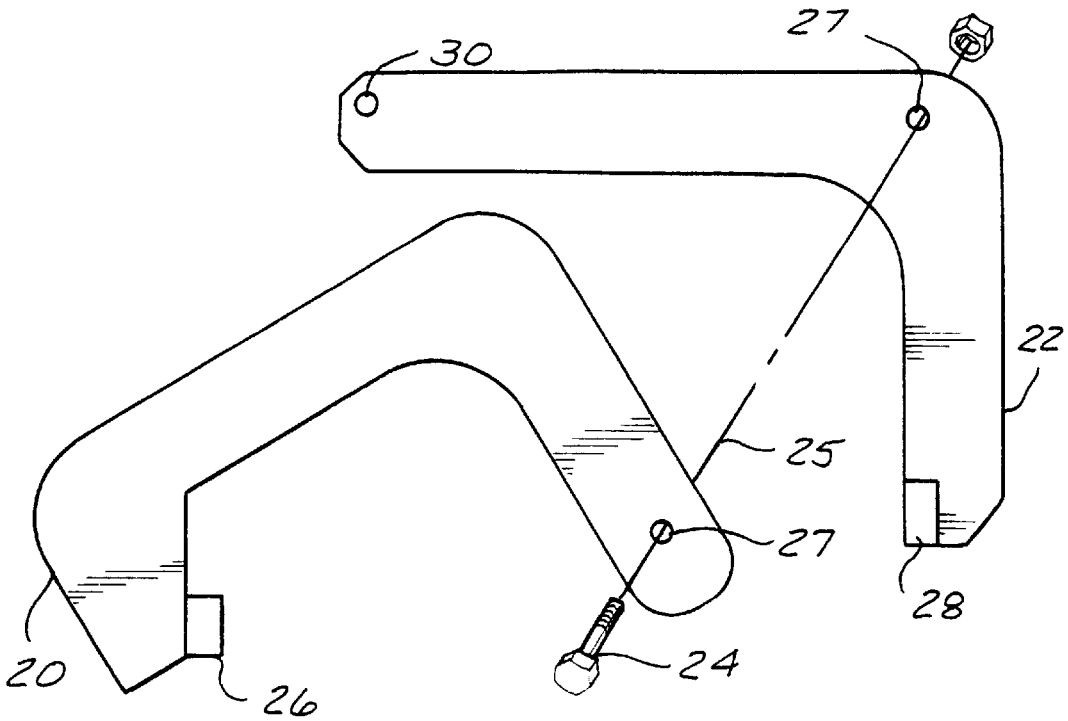
FIG. 3 is an exploded view of one of the pinch clamps of the present invention.

To connect the flexible support 16 to the pinch clamp 12, the outer leg 22 provides an aperture 30 extending therethrough, as seen in FIGS. 1–3. The flexible support 16 is preferably fabricated from a steel link chain 32 wherein the first link of the chain 32 is placed through the aperture 30 in the outer leg 22. The link chain 32 has its other end linked to a connector. The connector is preferably fabricated from a steel ring 36 which is engageable with the lifting device 18. The lifting device 18 provides an upwardly extending rod 37 connected to a cantilever beam 39 wherein the steel ring 36 is captured by the rod 37 and the beam 39. A separate link chain 32 is utilized for each of the pinch clamps 12.

The lifting apparatus 10 also provides a multipurpose steel hook 38 for secondarily engaging the manhole casting 14 or for engaging other structures that are not conducive to engagement with the pinch clamps 12. The hook 38 has a J-shaped structure that is pivotally connected to a steel link chain 40. The link chain 40 is also linked to the steel ring 36.

In an alternative embodiment, the pinch clamps 12' may be fabricated from a one-piece, integral construction. As in the preferred embodiment, the pinch clamp 12' is preferably fabricated from a hardened steel although the pinch clamp 12' may be fabricated from any high strength material commonly known to those skilled in the art. The inner leg 20' and the outer leg 22' are integrally connected to form a single plate-like structure having a substantially C-shaped configuration. A foot 42 is welded to the inside leg 20' of the pinch clamp 12' as similarly described in the preferred embodiment. Again, the foot 42 has a contact surface that is wider than the width of the inner leg 20'. This provides an optimum contact surface for engaging the manhole casting 14.

As similarly provided in the preferred embodiment, the pinch clamp 12' has an aperture 44 extending through an upper corner of the platelike structure of the pinch clamp 12'. The link chain 32 is linked with the pinch clamp 12' and the steel ring 36 at each of its ends, as similarly described in the preferred embodiment. A supplemental link chain 46 may be utilized to pull the link chains 32 closer together to enhance the pivoting angle of the pinch clamps 12' thereby enhancing the engagement of the manhole casting 14.

In operation, the steel ring 36 is connected to the lifting device 18, and the pinch clamps 12 are allowed to hang above the manhole casting 14. The lifting device 18 lowers the pinch clamps 12, and the pinch clamps 12 are pivotally opened to receive a portion of the manhole casting 14. The pinch clamps 12 are positioned such that the inner leg 20 is on the inside of the manhole casting 14 and the outer leg 22 is on the outside of the manhole casting 14. Although this is the preferred position for using the pinch clamps 12, the pinch clamps 12 will work in an inverted position wherein the inner leg 20 is on the outside of the manhole casting 14 and the outer leg 22 is on the inside of the manhole casting 14. The lifting apparatus 10 may also be utilized by other structures besides manhole casting 14.

Once in the proper position, the pinch clamps 12 are manually pivoted to engage the manhole casting 14 so as to prepare the pinch clamps 12 for lifting by the lifting device 18. The multi-purpose hook 38 may also be coupled to the manhole casting 14 at this time. The lifting device 18 raises the steel ring 36 thereby tightening the link chains 32 taut. The pinch clamps 12 pivot further under the tension of the link chains 32 thereby creating a tight engagement with the manhole casting 14. The lifting device 18 lifts the steel ring 36, link chains 32, and pinch clamps 12 higher until the manhole casting 14 is lifted from its seated position. The lifting device 18 may then be utilized to manipulate the manhole casting 14 to a desirable position. The manhole casting 14 is lowered to its desired position, and slack is introduced into the link chains 32. The pinch clamps 12 may then pivot to a size larger than the manhole casting 14 so that the pinch clamps 12 may be easily removed from the manhole casting 14. The lifting apparatus 10 may then be stored for future use.

While the invention has been described in connection with what is presently considered to be the most practical and preferred embodiment, it is to be understood that the invention is not to be limited to the disclosed embodiments, but on the contrary, it is intended to cover various modifications and equivalent arrangements included within the spirit and scope of the appended claims. The scope is to be accorded the broadest interpretation so as to encompass all such modifications and equivalent structures as is permitted under the law.

What is claimed is:

1. A lifting apparatus for lifting a manhole casting comprising:

at least one pinch clamp having an inner leg and an outer leg integrally fabricated from a one piece construction wherein said inner leg and said outer leg oppose one another wherein said inner leg and said outer leg are engageable with and invertible on opposite sides of a common wall of said manhole casting;

said inner leg and said outer leg each having a planar contact surface engageable with said manhole casting wherein one of said planar contact surfaces has a greater surface area than said other planar contact surface; and a flexible support pivotally connected to said pinch clamp and connectable to a lifting device wherein said planar contact surfaces of said inner and outer legs of said pinch clamp are engageable with said manhole casting when said flexible support is taut.

2. The lifting apparatus stated in claim 1, further comprising:

a pivot point formed in said pinch clamp for receiving said flexible support, and said pivot point extending further inward toward said manhole casting than said inner and outer legs when said flexible support is taut.

3. The lifting apparatus stated in claim 1, further comprising:

a connector pivotally connected to said flexible support and connectable to a lifting device.

4. A lifting apparatus for lifting a manhole casting, comprising:

at least one pinch clamp having an inner leg and an outer leg opposing one another wherein said inner leg and said outer leg are engageable with and invertible on opposite sides of a common wall of said manhole casting;

said inner leg and said outer leg each having a planar contact surface engageable with said manhole casting wherein said planar contact surfaces are at an acute angle with respect to one another;

a flexible support pivotally connected to said pinch clamp and connectable to a lifting device, wherein said planar contact surfaces of said inner and outer legs of said pinch clamp are engageable with said manhole casting when said flexible support is taut; and said inner leg and said outer leg having separate structures pivotally connected thereto.

5. A lifting apparatus for lifting a manhole casting comprising:

at least one pinch clamp having an inner leg and an outer leg opposing one another, wherein said inner leg and said outer leg are engageable with and invertible on opposite sides of a common wall of said manhole casting;

a foot connected to at least one of said inner leg and said outer leg wherein said foot is wider than the width of said inner leg and said outer leg, and said foot is engageable with said manhole casting;

a flexible support pivotally connected to said pinch clamp and connectable to a lifting device wherein said foot and said inner and outer legs of said pinch clamp are engageable with said manhole casting when said flexible support is taut;

a connector pivotally connected to said flexible support and connectable to a lifting device;

a second flexible support pivotally connected to said connector; and a multipurpose hook connected to said second flexible support.

6. A lifting apparatus for lifting a manhole casting, comprising:

at least one pinch clamp having an inner leg and an outer leg integrally fabricated to form a substantial C-shaped, one-piece construction and said inner leg and said outer leg opposing one another wherein said inner leg and said outer leg each have a planar contact surface engageable with and invertible on opposite sides of a common wall of said manhole casting;

a foot connected to one of said inner leg and said outer leg of said pinch clamp wherein said foot provides said planar contact surface with a greater surface area than said planar contact surface area of said other inner leg and said outer leg, and said planar contact surface of said foot engageable with said manhole casting; and a link chain pivotally connected to said pinch clamp and connectable to a lifting device wherein said pinch clamp is engageable with said manhole casting when said link chain is pulled taut.

7. The lifting apparatus as stated in claim 6, further comprising:

a pivot point formed in said pinch clamp for receiving said link chain, and said pivot point extending further inward toward said manhole casting than said inner leg and said outer leg when said link chain is pulled taut.

8. The lifting apparatus stated in claim 6, further comprising:

a connector pivotally connected to said link chain and connectable to a lifting device.

9. A lifting apparatus for lifting a manhole casting comprising:

at least one pinch clamp having an inner leg and an outer leg opposing one another wherein said inner leg and said outer leg each having a planar contact surface engageable with and invertible on opposite sides of a common wall of said manhole casting wherein said planar contact surfaces are at an acute angle with respect to one another;

a foot connected to at least one of said inner leg and said outer leg of said pinch clamp wherein said foot provides said planar contact surface with a wider surface than the width of said inner leg and said outer leg, and said planar contact surface of said foot engageable with said manhole casting;

a link chain pivotally connected to said pinch clamp and connectable to a lifting device wherein said pinch clamp is engageable with said manhole casting when said link chain is pulled taut; and said inner and outer legs of said pinch clamp fabricated from independent, substantially parallel structures lying in a pair of separate, substantially parallel planes wherein said inner and outer legs are pivotally connected about a pivotal axis.

10. The lifting apparatus stated in claim 9, further comprising:

said pair of separate planes of said inner and outer legs of said pinch clamp pivoting substantially normal to said pivotal axis.

11. A lifting apparatus for lifting a manhole casting, comprising:

at least one pinch clamp each having an inner leg and an outer leg opposing one another wherein said inner leg and said outer leg are engageable with and invertible on opposite sides of a common wall of said manhole casting;

a foot connected to at least one of said inner leg and said outer leg of said pinch clamp wherein said foot provides a contact surface wider than the width of said inner and outer leg, and said contact surface of said foot engageable with said manhole casting;

a link chain pivotally connected to said pinch clamp and connectable to a lifting device wherein said pinch clamp is engageable with said manhole casting when said link chain is pulled taut:

a connector pivotally connected to said link chain and connectable to a lifting device;

a second link chain pivotally connected to said connector; and a multiple purpose hook pivotally connected to said link chain.

12. A lifting apparatus for lifting manhole castings, comprising:

a pair of pinch clamps each having an inner leg and an outer leg integrally fabricated to form a substantially C-shaped one-piece structure and said inner leg and said outer leg opposing one another wherein said inner leg and said outer leg each have a planar contact surface engageable with and invertible on opposite sides of a common wall of said manhole casting;

a foot connected to at least one of said inner leg and said outer leg of said pinch clamp wherein said foot provides said planar contact surface with a surface area greater than said other planar contact surface formed on said other of said inner and said outer leg, and said planar contact surface of said foot engageable with said manhole casting;

a first link chain pivotally connected to one of said pair of said pinch clamps, and a second link chain pivotally connected to the other of said pair of pinch clamps; and a ring member pivotally connected to said first and second link chains, and said ring member connectable to a lifting device wherein said pair of pinch clamps are engageable with said manhole casting when said first and second link chains are pulled taut.

13. The lifting apparatus stated in claim 12, further comprising:

said pinch clamps each having an aperture for defining a pivot point and said pivot point receiving said first and second link chains wherein said pivot point extends further inward toward said manhole casting than said inner and outer legs of said pinch clamps.

14. A lifting apparatus for lifting manhole castings comprising:

a pair of pinch clamps each having an inner leg and an outer leg opposing one another wherein said inner leg and said outer leg each have a planar contact surface engageable with and invertible on opposite sides of a common wall of said manhole casting wherein said planar contact surfaces are at an acute angle with respect to one another;

foot connected to at least one of said inner leg and said outer leg of said pinch clamp wherein said foot provides said planar contact surface with a wider surface than the width of said inner leg and said outer leg, and said planar contact surface of said foot engageable with said manhole casting;

a first link chain pivotally connected to one of said pair of said pinch clamps, and a second link chain pivotally connected to the other of said pair of said pinch clamps;

a ring member pivotally connected to said first and second link chains, and said ring member connectable to a lifting device wherein said pair of pinch clamps are engageable with said manhole casting when said first and second link chains are pulled taut; and said inner and outer legs of said pinch clamp having independent L-shaped structures that are substantially parallel to one another and are pivotally connectable about a pivotal axis.

15. The lifting apparatus stated in claim 14, further comprising:

said inner and outer legs of said pinch clamp pivoting in a plane substantially normal to said pivotal axis.

16. A lifting apparatus for lifting manhole castings comprising:

a pair of pinch clamps each having an inner leg and an outer leg opposing one another wherein said inner leg and said outer leg are engageable with and invertible on opposite sides of the common wall of said manhole casting;

a foot connected to at least one of said inner leg and said outer leg of said pinch clamp wherein said foot provides a contact surface wider than the width of said inner leg and said outer leg, and said contact surface of said foot engageable with said manhole casting, a first link chain pivotally connected to one of said pair of said pinch clamps, and a second link chain pivotally connected to the other of said pair of pinch clamps, a ring member pivotally connected to said first and second link chains, and said ring member connectable to a lifting device wherein said pair of pinch clamps are engageable with said manhole casting when said first and second link chains are pulled taut, said inner and outer legs of said pinch clamp having independent L-shaped structures that are substantially parallel to one another and are pivotally connectable about a pivotal axis, a second link chain pivotally connected to said ring member; and a multipurpose hook pivotally connected to said second link chain.

17. A lifting apparatus for lifting manhole castings, comprising:

a pair of pinch clamps each having an inner leg and an outer leg opposing one another wherein said inner leg and said outer leg each have a planar contact surface engageable with and invertible on opposite sides of a common wall of said manhole casting wherein said planar contact surfaces are at an acute angle with respect to one another;

a foot connected to at least one of said inner leg and said outer leg of said pinch clamp wherein said foot provides said planar contact surface with a wider surface than the width of said inner and outer leg, and said planar contact surface of said foot engageable with said manhole casting;

a first link chain pivotally connected to one of said pair of said pinch clamps, and a second link chain pivotally connected to the other of said pair of pinch clamps;

a ring member pivotally connected to said first and second link chains, and said ring member connectable to a lifting device wherein said pair of pinch clamps are engageable with said manhole casting when said first and second link chains are pulled taut; and a supplemental link chain pivotally connected to and extending between said first and second link chains.

18. A lifting apparatus for lifting a manhole casting, comprising:

at least one pinch clamp having an inner leg and an outer leg opposing one another wherein said inner leg and said outer leg each have a planar contact surface engageable with and invertible on opposite sides of a common wall of said manhole casting wherein one of said planar contact surfaces has a greater surface area than said other planar contact surface; and a support member pivotally connected to said pinch clamp wherein said inner and outer legs of said pinch clamp are engageable with said manhole casting when said member applies an upward force to said pinch clamp.

19. The lifting apparatus as stated in claim 18, further comprising:

said support member pivotally connected to said pinch clamp at a pivot point that is not within said inner and outer legs wherein said pivot point extends further inward toward said manhole casting than said inner and outer legs when said support member applies an upward force to said pinch clamp.

* * * * *

UNITED STATES PATENT AND TRADEMARK OFFICE

CERTIFICATE OF CORRECTION

PATENT NO. : 6,609,742 B1
DATED : August 26, 2003
INVENTOR(S) : Macom et al.

It is certified that error appears in the above-identified patent and that said Letters Patent is hereby corrected as shown below:

Column 1,
Line 66, please insert -- , and -- after "member"; and

Column 7,
Line 12, please insert -- a -- before "foot".

Signed and Sealed this

Seventh Day of October, 2003

JAMES E. ROGAN
*Director of the United States Patent and Trademark Office*